US011410598B2

(12) United States Patent
Jang et al.

(10) Patent No.: US 11,410,598 B2
(45) Date of Patent: Aug. 9, 2022

(54) DISPLAY DEVICE

(71) Applicant: Samsung Display Co., Ltd., Yongin-Si (KR)

(72) Inventors: Jin Hee Jang, Yongin-si (KR); Kyong Hwan Oh, Yongin-si (KR); Jae Sic Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/907,984

(22) Filed: Jun. 22, 2020

(65) Prior Publication Data

US 2021/0193024 A1 Jun. 24, 2021

(30) Foreign Application Priority Data

Dec. 20, 2019 (KR) ..... 10-2019-0172238

(51) Int. Cl.
*G09G 3/32* (2016.01)

(52) U.S. Cl.
CPC ..... *G09G 3/32* (2013.01); *G09G 2300/0842* (2013.01); *G09G 2320/0238* (2013.01)

(58) Field of Classification Search
USPC ..... 345/690
See application file for complete search history.

(56) References Cited

U.S. PATENT DOCUMENTS

| | | | | |
|---|---|---|---|---|
| 9,293,082 | B2 | 3/2016 | Jeon | |
| 10,339,862 | B2 | 7/2019 | Yoon et al. | |
| 2015/0243210 | A1 | 8/2015 | Park et al. | |
| 2015/0364083 | A1* | 12/2015 | Jeon | G09G 3/3233 345/76 |
| 2017/0061875 | A1* | 3/2017 | Cho | G09G 3/3233 |
| 2018/0261163 | A1 | 9/2018 | Hyun et al. | |
| 2019/0096330 | A1 | 3/2019 | Kim et al. | |
| 2020/0388228 | A1* | 12/2020 | Oh | G09G 5/373 |

FOREIGN PATENT DOCUMENTS

| | | | |
|---|---|---|---|
| KR | 10-2015-0101505 | A | 9/2015 |
| KR | 10-2015-0144882 | A | 12/2015 |
| KR | 10-2017-0020595 | A | 2/2017 |
| KR | 10-2018-0104790 | A | 9/2018 |
| KR | 10-2019-0034375 | A | 4/2019 |

* cited by examiner

*Primary Examiner* — Ifedayo B Iluyomade
(74) *Attorney, Agent, or Firm* — Innovation Counsel LLP

(57) ABSTRACT

A display device according to an embodiment of the present disclosure is provided. The display device comprises a light emitting diode, a first transistor connected between an initialization power source and an anode of the light emitting diode and having a gate electrode connected to an initialization line, and an initialization driver for supplying an initialization signal to the initialization line. The initialization driver supplies the initialization signal every frame when driven at a first frequency and supplies the initialization signal every set of two or more frames when driven at a second frequency different from the first frequency.

15 Claims, 10 Drawing Sheets

DISPLAY DEVICE

CROSS-REFERENCE TO RELATED APPLICATION

This application claims priority to, and the benefit of, Korean Patent Application No. 10-2019-0172238 filed on Dec. 20, 2019 in the Korean Patent Office (KIPO), the entire content of which is incorporated herein by reference.

BACKGROUND

1. Field

Embodiments of the present disclosure relate to a display device.

2. Discussion of Related Art

With the development of information technology, the importance of display devices, which are a connection medium between users and information, has been emphasized. In response to this, the use of display devices such as a liquid crystal display device, an organic light emitting display device, and other display devices has been increasing.

A display device comprises pixels positioned in regions divided by scan lines and data lines, a scan driver for driving the scan lines, and a data driver for driving the data lines.

The scan driver supplies a scan signal to the scan lines, whereby the pixels are selected in units of horizontal lines. The data driver supplies a data signal synchronized with the scan signal. Then, the data signal is supplied to the pixels selected by the scan signal. The pixels receiving the data signal emit light having a predetermined luminance while controlling the amount of current flowing from a first power source to a second power source via a light emitting diode. In addition, the emission time of the pixels is controlled by an emission control signal supplied from an emission control line.

On the other hand, in the display device, when a low grayscale, e.g., black, data signal is supplied, an operation for discharging or initializing a parasitic capacitor of the light emitting diode may be performed every frame to improve a black expression ability.

SUMMARY

Recently, display devices are driven at a high frequency (or high scanning rate) to provide high quality images. When a display device is driven at the high frequency, the number of frames displayed every second increases, so that the screen may be smoothly switched.

However, when an operation for discharging a parasitic capacitor of a light emitting diode is performed every frame in the display device driven at the high frequency, luminance and color deviation between pixels that may occur at low grayscale may increase according to the dispersion of a display panel.

A feature of the present disclosure is to provide a display device capable of reducing the luminance and color deviation between the pixels that may occur in the low grayscale when the display device is driven at the high frequency.

According to an embodiment of the present disclosure, a display device may comprise: a light emitting diode; a first transistor connected between an initialization power source and an anode of the light emitting diode and having a gate electrode connected to an initialization line; and an initialization driver for supplying an initialization signal to the initialization line.

The initialization driver may supply the initialization signal every set of two or more frames when driven at a first frequency.

The initialization driver may supply the initialization signal every frame when driven at a second frequency different from the first frequency, and the first frequency may be higher than the second frequency.

The first frequency may be 120 Hz and the second frequency may be 60 Hz.

The set may be two frames.

The display device according to an embodiment of the present disclosure may further comprise: a scan driver for supplying a scan signal to a scan line; a data driver for supplying a data signal to a data line; an emission control driver for supplying an emission control signal to an emission control line; and a timing controller for controlling the scan driver, the data driver, the emission control driver, and the initialization driver.

The scan driver may be driven at the first frequency and supply the scan signal every one frame, and the emission control driver may be driven at the first frequency and supply the emission control signal every one frame.

The display device according to an embodiment of the present disclosure may further comprise: a second through seventh transistors and a storage capacitor. The second transistor has a first electrode connected to the anode of the light emitting diode and a gate electrode connected to the emission control line. The third transistor has a first electrode connected to a first power source and a gate electrode connected to the emission control line. The fourth transistor has a first electrode connected to a second electrode of the third transistor, a second electrode connected to a second electrode of the second transistor, and a gate electrode connected to a first node. The fifth transistor is connected between the first node and the second electrode of the fourth transistor and has a gate electrode connected to a first scan line. The sixth transistor is connected between the first node and the initialization power source and has a gate electrode connected to a second scan line. The seventh transistor is connected between the data line and the first electrode of the fourth transistor and has a gate electrode connected to the first scan line. The storage capacitor is connected between the first power source and the first node.

The scan driver may supply the scan signal to the first scan line every frame to overlap the emission control signal.

The initialization driver may supply the initialization signal the every set to overlap the emission control signal when driven at the second frequency.

The initialization signal may be supplied after the scan signal and the initialization signal and the scan signal may not overlap each other.

The initialization driver may supply the initialization signal every frame regardless of the emission control signal when driven at the first frequency.

According to an embodiment of the present disclosure, a method of driving a display device may comprise: supplying an initialization signal every set of two or more frames when driven at a first frequency to apply an initialization voltage to an anode of a light emitting diode of a pixel of pixels.

The method according to an embodiment of the present disclosure may further comprise: supplying the initialization signal every frame when driven at a second frequency different from the first frequency to apply the initialization voltage to the anode of the light emitting diode.

The method according to an embodiment of the present disclosure may further comprise: setting the pixels to a non-light emitting state before applying the initialization voltage to the anode of the light emitting diode; and charging the pixels with a voltage corresponding to a data signal. The pixels may sequentially emit light in units of horizontal lines to correspond to the charged voltage.

The first frequency may be higher than the second frequency.

The first frequency may be 120 Hz and the second frequency may be 60 Hz.

According to an embodiment of the present disclosure, a display device may comprise: a scan driver for supplying scan signals to scan lines, respectively; a data driver for supplying data signals to data lines, respectively; an emission control driver for supplying emission control signals to emission control lines, respectively; a first initialization driver for supplying first initialization signals to odd-numbered initialization lines, respectively; a second initialization driver for supplying second initialization signals to even-numbered initialization lines, respectively; a timing controller for controlling the scan driver, the data driver, the emission control driver, and the first and second initialization drivers; and pixels located at intersections of the scan lines and the data lines.

The scan driver, the emission control driver, and the first and second initialization drivers may be driven at a high frequency.

The high frequency may be 120 Hz.

The scan driver may supply the scan signals every frame, the emission control driver may supply the emission control signals every frame, the first initialization driver may supply the first initialization signals every odd-numbered frame, and the second initialization driver may supply the second initialization signals every even-numbered frame.

A pixel positioned on an i-th horizontal line among the pixels may comprise: a light emitting diode; a first transistor connected between an initialization power source and an anode of the light emitting diode and having a gate electrode connected to an i-th initialization line; second through seventh transistors; and a storage capacitor. The second transistor has a first electrode connected to the anode of the light emitting diode and a gate electrode connected to an i-th emission control line. The third transistor has a first electrode connected to a first power source and a gate electrode connected to the i-th emission control line. The fourth transistor has a first electrode connected to a second electrode of the third transistor, a second electrode connected to a second electrode of the second transistor, and a gate electrode connected to a first node. The fifth transistor is connected between the first node and the second electrode of the fourth transistor and has a gate electrode connected to a first scan line. The sixth transistor is connected between the first node and the initialization power source and has a gate electrode connected to a second scan line. The seventh transistor is connected between a data line and the first electrode of the fourth transistor and has a gate electrode connected to the first scan line. The storage capacitor is connected between the first power source and the first node.

The first scan line may be an i-th scan line and the second scan line may be an (i−1)th scan line, where i is a natural number.

The scan driver may supply an scan signal to the first scan line at one frame period to overlap an emission control signal supplied to the i-th emission control line, the first initialization driver may supply the first initialization signals to the odd-numbered initialization lines every odd-numbered frame to overlap the emission control signal supplied to the i-th emission control line, and the second initialization driver may supply the second initialization signals to the even-numbered initialization lines every even-numbered frame to overlap the emission control signal supplied to the i-th emission control line.

BRIEF DESCRIPTION OF THE DRAWINGS

The above and other aspects of the present disclosure will become more apparent by describing in further detail embodiments with reference to the accompanying drawings.

DETAILED DESCRIPTION

Figure 1:
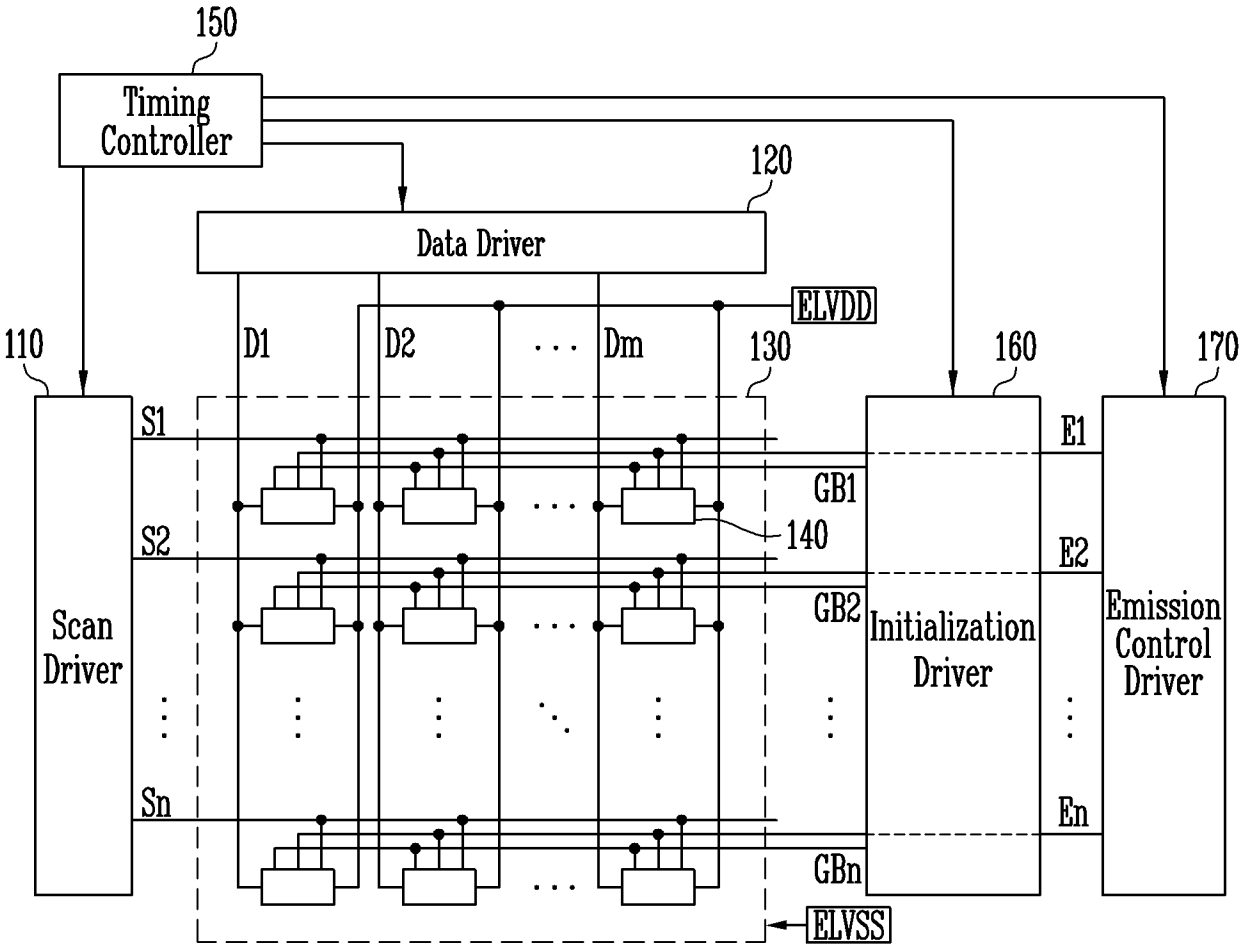
FIG. 1 is a block diagram illustrating a display device according to embodiments of the present disclosure.

Like reference numerals refer to like elements. In addition, in the drawings, the thicknesses, proportions, and dimensions of elements are exaggerated to effectively explain the technical content. The term "and/or" comprises one or more combinations that may be defined by associated configurations.

The terms "first", "second", and so forth may be used to describe various elements, but the elements should not be limited by these terms. These terms are used only for the purpose of distinguishing one element from another element. For example, a first element may be referred to as a second element, and similarly the second element may be referred to as the first element without departing from the scope of the present disclosure. Singular expressions may include plural expressions unless the context clearly indicates otherwise.

The terms "including", "having", and similar terms are intended to designate features, numbers, steps, operations, elements, components, or combinations of the features, numbers, steps, operations, elements, components described in the disclosure. It should be understood that it does not exclude the possibility of the presence or addition of one or more other features, numbers, steps, operations, elements, components, or combinations of the features, numbers, steps, operations, elements, and components.

In the following description, when a part is connected to another part, this includes not only a case in which the part is directly connected, but also a case in which another part is connected in between.

FIG. 1 is a block diagram illustrating a display device according to an embodiment of the present disclosure.

Referring to FIG. 1, a display device according to an embodiment of the present disclosure may include a pixel unit 130 (or a pixel circuit) including pixels 140 positioned at intersections of scan lines S1 to Sn and data lines D1 to Dm, a scan driver 110 for driving the scan lines S1 to Sn, a data driver 120 for driving the data lines D1 to Dm, an initialization driver 160 for driving initialization lines GB1 to GBn, an emission control driver 170 for driving emission control lines E1 to En, and a timing controller 150 for controlling the scan driver 110, the data driver 120, and the initialization driver 160.

The scan driver 110 may supply scan signals to the scan lines S1 to Sn under the control of the timing controller 150. For example, the scan driver 110 may sequentially supply the scan signals to the scan lines S1 to Sn.

The emission control driver 170 may supply emission control signals to the emission control lines E1 to En under the control of the timing controller 150. For example, the emission control driver 170 may sequentially supply the emission control signals to the emission control lines E1 to En.

Here, the scan signals may be supplied while the emission control signals are supplied. For example, an emission control signal may be supplied to overlap at least two scan signals. The emission control signals may be set to a gate-off voltage, for example, a high voltage, so that transistors included in the pixels 140 may be turned off. In addition, the scan signals may be set to a gate-on voltage, for example, a low voltage, so that the transistors included in the pixels 140 may be turned on.

The data driver 120 may supply data signals to the data lines D1 to Dm under the control of the timing controller 150. The data signals supplied to the data lines D1 to Dm may be supplied to the pixels 140, units of horizontal lines, selected by the scan signals.

The initialization driver 160 may supply initialization signals to the initialization lines GB1 to GBn under the control of the timing controller 150. For example, the initialization driver 160 may sequentially supply the initialization signals to the initialization lines GB1 to GBn. In addition, the initialization signals may be set to a gate-on voltage so that the transistors included in the pixels 140 may be turned on.

The pixel unit 130 may include the scan lines S1 to Sn, the initialization lines GB1 to GBn, and the emission control lines E1 to En formed in a first direction, for example, a horizontal direction, and the pixels 140 positioned at the intersections of the data lines D1 to Dm formed in a second direction, for example, a vertical direction. The pixels 140 may be selected in units of horizontal lines by the scan signals and store the data signals received from the data lines D1 to Dm. Thereafter, each of the pixels 140 may emit light having a predetermined luminance while controlling the amount of current flowing from a first power source ELVDD to a second power source ELVSS via a light emitting diode in response to a data signal.

The timing controller 150 may control the scan driver 110, the data driver 120, and the initialization driver 160 in response to signals supplied from outside.

Each of the pixels 140 is illustrated as being connected to one scan line in FIG. 1. However, the pixels 140 may be connected to more than one scan line according to the structure of the pixels 140. In this case, dummy scan lines may be additionally formed in the pixel unit 130.

Figure 2:
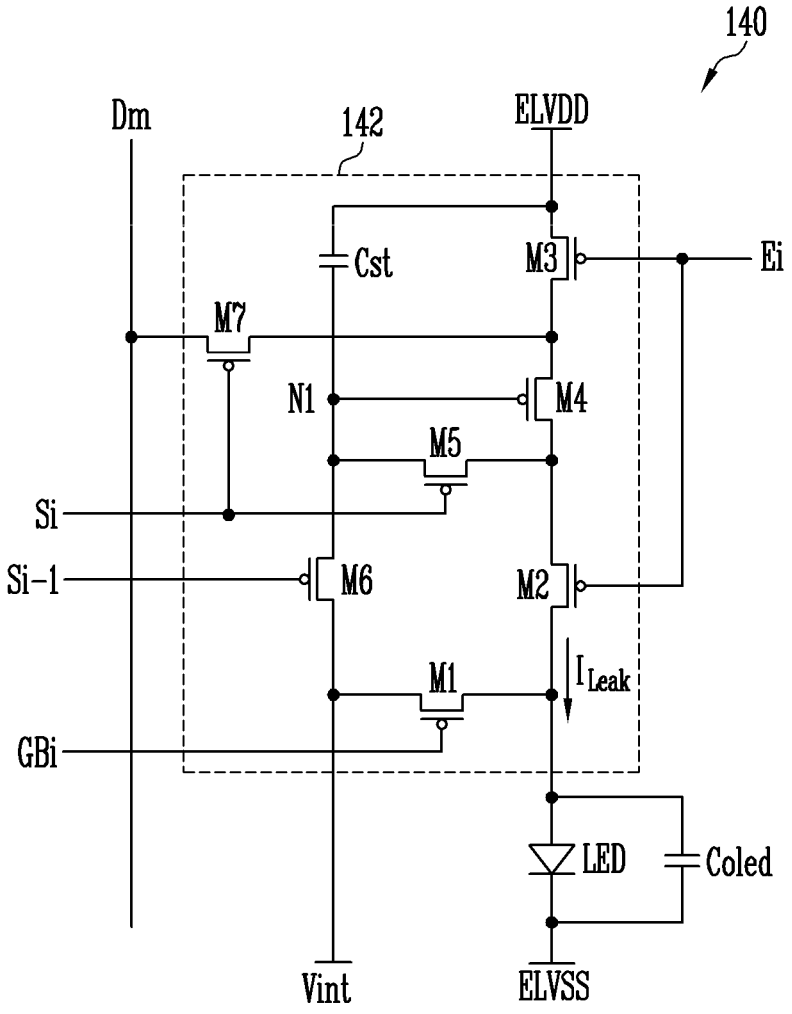
FIG. 2 is a circuit diagram illustrating an example of a pixel comprised in the display device of FIG. 1.

FIG. 2 is a circuit diagram illustrating an example of the pixel 140 included in the display device of FIG. 1. In FIG. 2, the pixel 140 connected to an m-th data line Dm and an i-th scan line Si will be described.

Referring to FIG. 2, the pixel 140 according to an embodiment of the present disclosure may comprise a light emitting diode LED, first to seventh transistors M1, M2, M3, M4, M5, M6, and M7, and a storage capacitor Cst.

An anode of the light emitting diode LED may be connected to a pixel circuit 142, and a cathode of the light emitting diode LED may be connected to the second power source ELVSS. The light emitting diode LED may emit light having a predetermined luminance corresponding to the amount of current supplied from the pixel circuit 142.

The pixel circuit 142 may control the amount of current flowing from the first power source ELVDD to the second power source ELVSS via the light emitting diode LED in response to the data signal. For example, the pixel circuit 142 may initialize a gate electrode of a driving transistor when a scan signal is supplied to an (i−1)th scan line Si−1, and store the data signal received from the m-th data line Dm when the scan signal is supplied to the i-th scan line Si. In addition, the pixel circuit 142 may control the amount of current supplied to the light emitting diode LED in response to the data signal when the supply of an emission control signal to an i-th emission control line Ei is stopped.

The pixel circuit 142 may be implemented by various types of circuits known in the art. In addition, the first power source ELVDD may be set to a higher voltage than the second power source ELVSS so that the current may flow to the light emitting diode LED.

The first transistor M1 may be connected between an initialization power source Vint and the anode of the light emitting diode LED. A gate electrode of the first transistor M1 may be connected to an i-th initialization line GBi (or a control line). The first transistor M1 may be turned on when an initialization signal is supplied to the i-th control line GBi to supply a voltage of the initialization power source Vint to the anode of the light emitting diode LED. Here, the initialization power source Vint may be set to a lower voltage than the data signal.

The first transistor M1 may improve black expression ability of the pixel 140. In other words, when the first transistor M1 is turned on, a parasitic capacitor Coled of the light emitting diode LED may be discharged. Then, when black luminance is implemented, the light emitting diode LED does not emit light due to a leakage current supplied through the second transistor M2, and thus, the black expression ability may be improved.

In detail, the parasitic capacitor Coled may be charged with a predetermined voltage corresponding to the current supplied from the pixel circuit 142 during a previous frame period. When the parasitic capacitor Coled is charged, the light emitting diode LED can easily emit light even by a low current.

A low grayscale, e.g., black, data signal may be supplied to the pixel circuit 142 in the current frame period. Ideally, when the low grayscale, e.g., black, data signal is supplied, the pixel circuit 142 may not supply current to the light emitting diode LED. However, in the pixel circuit 142 composed of transistors, even when the low grayscale, e.g., black, data signal is supplied, a predetermined leakage current Ileak may be supplied to the light emitting diode LED. In this case, when the parasitic capacitor Coled is charged, the light emitting diode LED may emit light minutely, and thus the black expressing ability may be degraded.

On the other hand, when the parasitic capacitor Coled is discharged by the voltage of the initialization power source Vint, the light emitting diode LED may be set to a non-light emitting state even when the leakage current Ileak is supplied.

In addition, the initialization driver 160 may supply the initialization signal to the i-th initialization line GBi to overlap the emission control signal supplied to the i-th emission control line Ei in at least some period. Detailed descriptions of supplying the initialization signal by the initialization driver 160 will be described later.

The second transistor M2 may be connected between the fourth transistor M4 and the anode of the light emitting diode LED. A gate electrode of the second transistor M2 may be connected to the i-th emission control line Ei. The second transistor M2 may be turned off when the emission control signal is supplied to the i-th emission control line Ei, and may be turned on in other cases.

The third transistor M3 may be connected between the first power source ELVDD and the fourth transistor M4. A gate electrode of the third transistor M3 may be connected to the i-th emission control line Ei. The third transistor M3 may be turned off when the emission control signal is supplied to the i-th emission control line Ei, and may be turned on in other cases.

A first electrode of the fourth transistor M4, e.g., a driving transistor, may be connected to the first power source ELVDD via the third transistor M3, and a second electrode of the fourth transistor M4 may be connected to the anode of the light emitting diode LED via the second transistor M2. A gate electrode of the fourth transistor M4 may be connected to a first node N1. The fourth transistor M4 may control the amount of current flowing from the first power source ELVDD to the second power source ELVSS via the light emitting diode LED in response to a voltage of the first node N1.

The fifth transistor M5 may be connected between the second electrode of the fourth transistor M4 and the first node N1. A gate electrode of the fifth transistor M5 may be connected to the i-th scan line Si. The fifth transistor M5 may be turned on when the scan signal is supplied to the i-th scan line Si to electrically connect the second electrode of the fourth transistor M4 and the first node N1. Therefore, when the fifth transistor M5 is turned on, the fourth transistor M4 may be connected in the form of a diode.

The sixth transistor M6 may be connected between the first node N1 and the initialization power source Vint. A gate electrode of the sixth transistor M6 may be connected to the (i−1)th scan line Si−1. The sixth transistor M6 may be turned on when the scan signal is supplied to the (i−1)th scan line Si−1 to supply the voltage of the initialization power source Vint to the first node N1.

The seventh transistor M7 may be connected between the m-th data line Dm and the first electrode of the fourth transistor M4. A gate electrode of the seventh transistor M7 may be connected to the i-th scan line Si. The seventh transistor M7 may be turned on when the scan signal is supplied to the i-th scan line Si to electrically connect the m-th data line Dm and the first electrode of the fourth transistor M4.

The storage capacitor Cst may be connected between the first power source ELVDD and the first node N1. The storage capacitor Cst may store a voltage corresponding to the data signal and a threshold voltage of the fourth transistor M4.

Figure 3A:
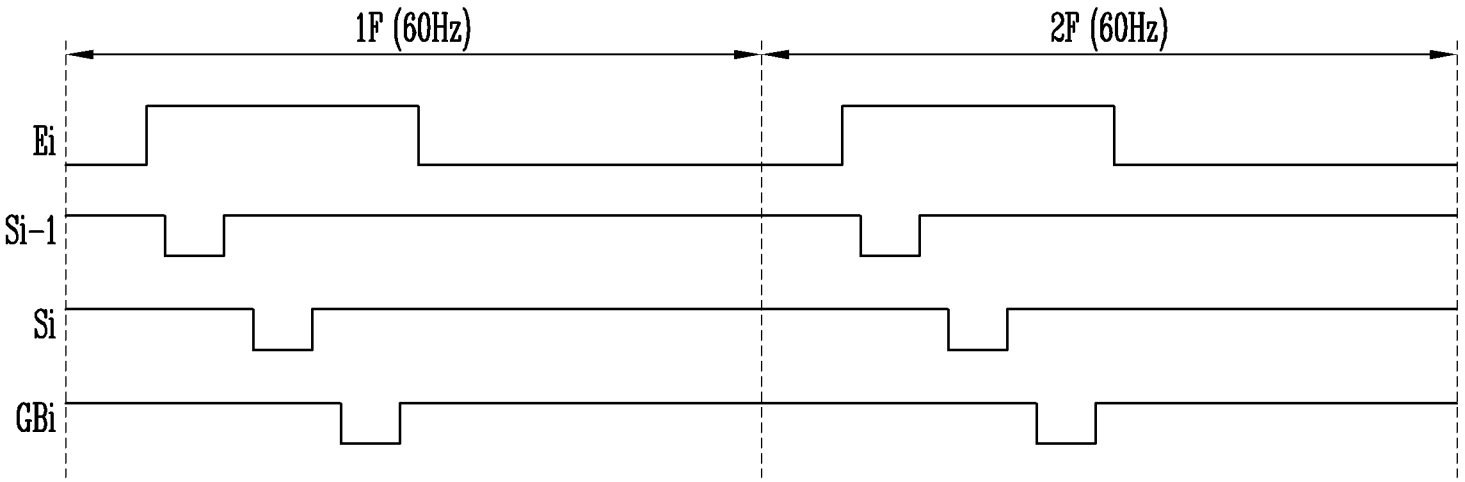
FIG. 3A is a waveform diagram illustrating a method of driving the pixel illustrated in FIG. 2 according to embodiments of the present disclosure.

FIG. 3A is a waveform diagram illustrating a method of driving the pixel 140 illustrated in FIG. 2 according to an embodiment of the present disclosure. In this case, as an example, the scan driver 110, the initialization driver 160, and the emission control driver 170 may be driven at a low frequency, such as 60 Hz per frame. However, the driving frequency is described as an example for convenience of description and other driving frequencies are used in other embodiments.

Referring to FIGS. 1, 2 and 3A, first, the emission control signal may be supplied to the i-th emission control line Ei every frame 1F and 2F. When the emission control signal is supplied to the i-th emission control line Ei, the second transistor M2 and the third transistor M3 may be turned off.

When the third transistor M3 is turned off, the first power source ELVDD and the first electrode of the fourth transistor M4 may be electrically separated from each other. When the second transistor M2 is turned off, the second electrode of the fourth transistor M4 and the anode of the light emitting diode LED may be electrically separated from each other. Therefore, the pixel 140 may be set to the non-light emitting state during a period in which the emission control signal is supplied to the i-th emission control line Ei.

Thereafter, the scan signal may be supplied to the (i−1)th scan line Si−1. When the scan signal is supplied to the (i−1)th scan line Si−1, the sixth transistor M6 may be turned on. When the sixth transistor M6 is turned on, the voltage of the initialization power source Vint may be supplied to the first node N1.

After the scan signal is supplied to the (i−1)th scan line Si−1, the scan signal may be supplied to the i-th scan line Si. When the scan signal is supplied to the i-th scan line Si, the fifth transistor M5 and the seventh transistor M7 may be turned on.

When the fifth transistor M5 is turned on, the first node N1 and the second electrode of the fourth transistor M4 may be electrically connected to each other. That is, when the fifth transistor M5 is turned on, the fourth transistor M4 may be connected in the form of the diode.

When the seventh transistor M7 is turned on, the data signal from the m-th data line Dm may be supplied to the first electrode of the fourth transistor M4. In this case, since the first node N1 is initialized to the voltage of the initialization power source Vint, the fourth transistor M4 may be turned on. When the fourth transistor M4 is turned on, a voltage obtained by subtracting an absolute value of the threshold voltage of the fourth transistor M4 from a voltage of the data signal may be supplied to the first node N1. In this case, the storage capacitor Cst may store the voltage corresponding to the data signal and the threshold voltage of the fourth transistor M4.

Thereafter, the initialization signal may be supplied to the i-th initialization line GBi. When the initialization signal is supplied to the i-th initialization line GBi, the first transistor M1 may be turned on. When the first transistor M1 is turned on, the voltage of the initialization power source Vint may be supplied to the anode of the light emitting diode LED, and thus the parasitic capacitor of the light emitting diode LED may be discharged.

After the initialization signal is supplied to the i-th initialization line GBi, the supply of the emission control signal to the i-th emission control line Ei may be stopped. When the supply of the emission control signal to the i-th emission control line Ei is stopped, the second transistor M2 and the third transistor M3 may be turned on. When the third transistor M3 is turned on, the first power source ELVDD and the first electrode of the fourth transistor M4 may be electrically connected to each other. When the second transistor M2 is turned on, the second electrode of the fourth transistor M4 and the anode of the light emitting diode LED may be electrically connected to each other.

In this case, the fourth transistor M4 may control the amount of current flowing from the first power source ELVDD to the second power source ELVSS via the light emitting diode LED in response to the voltage of the first node N1. Then, the light emitting diode LED may emit light having a predetermined luminance corresponding to the amount of current supplied from the fourth transistor M4.

Figure 3B:
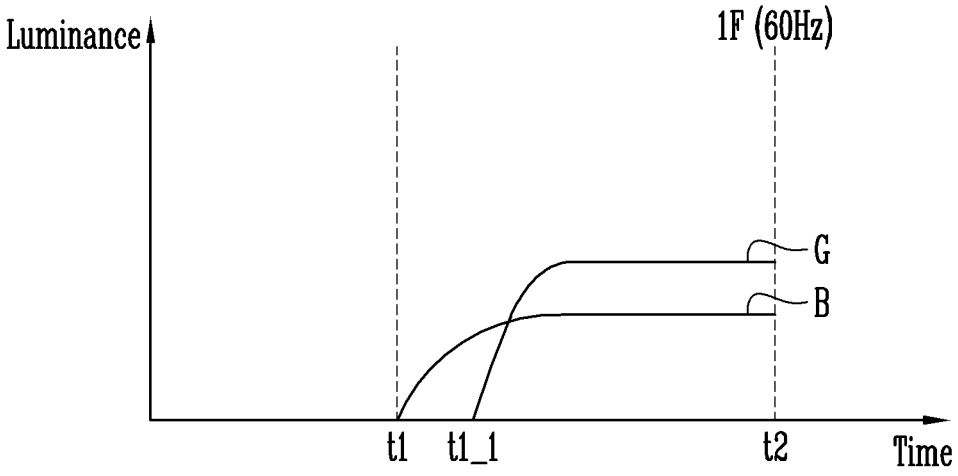
FIG. 3B is a diagram for explaining a case where an initialization driver is driven at a low frequency, for example, 60 Hz, similarly to a scan driver.
Figure 3C:
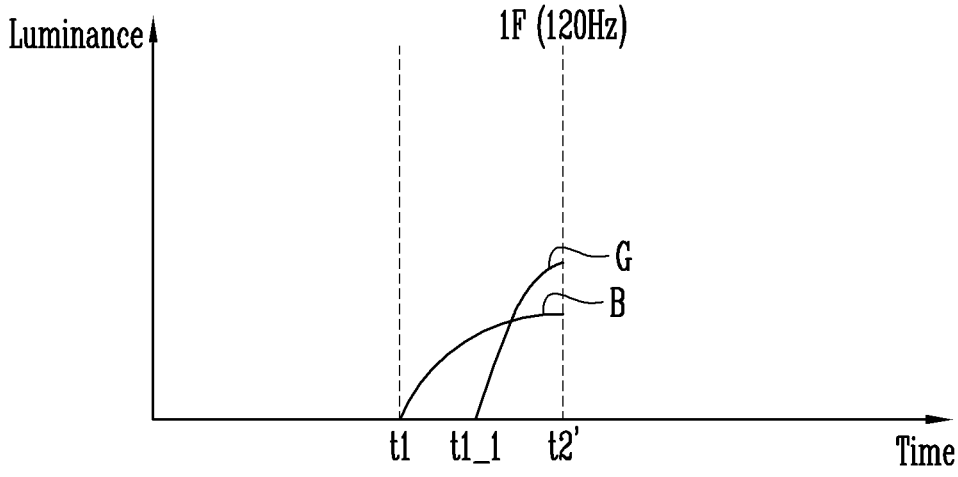
FIG. 3C is a diagram for explaining a problem in a case where the initialization driver is driven at a high frequency, for example, 120 Hz, similarly to the scan driver.

FIG. 3B is a diagram for explaining a case where an initialization driver is driven at a low frequency, for example, 60 Hz, similarly to a scan driver. FIG. 3C is a diagram for explaining a problem in a case where the initialization driver is driven at a high frequency, for example, 120 Hz, similarly to the scan driver.

In this case, the time where the parasitic capacitor Coled of the light emitting diode LED is charged differs according to the emitting color of the light emitting diode LED. This is because the operation points (or threshold voltages) are different when the light-emitting diodes LED have different emission colors. According to an embodiment of the present disclosure, the time where the parasitic capacitor Coled of the light emitting diode LED is charged may increase in the order of blue, red, and green.

Referring to FIGS. 3B and 3C, when both the scan driver 110 and the initialization driver 160 are driven at the high frequency, for example, 120 Hz, the color deviation between the pixels 140 at the low grayscale may be increased as compared to the case of driving at the low frequency, for example, 60 Hz.

For example, as illustrated in FIG. 3B, when both the scan driver 110 and the initialization driver 160 are driven at the low frequency of 60 Hz per frame, the light emitting time of the light emitting diode LED initialized by the initialization driver 160 may be sufficiently secured.

That is, the light emitting diode LED emitting blue light B may be in the non-light emitting state during a first time t1 where the parasitic capacitor Coled is charged, and the light emitting diode LED emitting green light G may be in the non-light emitting state during a first time t1_1 where the parasitic capacitor Coled is charged. However, the light emitting time of both the light emitting diodes LED emitting blue light B and green light G until a second time t2 corresponding to one frame can be sufficiently secured even when the dispersion between the pixels 140 is taken into consideration.

On the other hand, as illustrated in FIG. 3C, when both the scan driver 110 and the initialization driver 160 are driven at the high frequency of 120 Hz per frame, the light emitting time of the light emitting diode LED initialized by the initialization driver 160 may not be sufficiently secured.

That is, the light emitting diode LED emitting blue light B may be in the non-light emitting state during the first time t1 where the parasitic capacitor Coled is charged, and the light emitting diode LED emitting green light G may be in the non-light emitting state during the first time t1_1 where the parasitic capacitor Coled is charged.

A second time t2' corresponding to one frame is relatively short compared to a second time t2 when driving at the low frequency of 60 Hz. Therefore, the light emitting time of the light emitting diode LED emitting blue light B may be secured to a certain level even when the dispersion between the pixels 140 is taken into consideration. However, since the light emitting time of the light emitting diode LED emitting green light G is relatively short, luminance and color deviation may increase according to the dispersion between the pixels 140.

Hereinafter, as an embodiment of the present disclosure, when both the scan driver 110 and the initialization driver 160 are driven at the high frequency, such as 120 Hz per frame, a driving method for sufficiently securing the light emitting time of the light emitting diode LED will be described.

Figure 4:
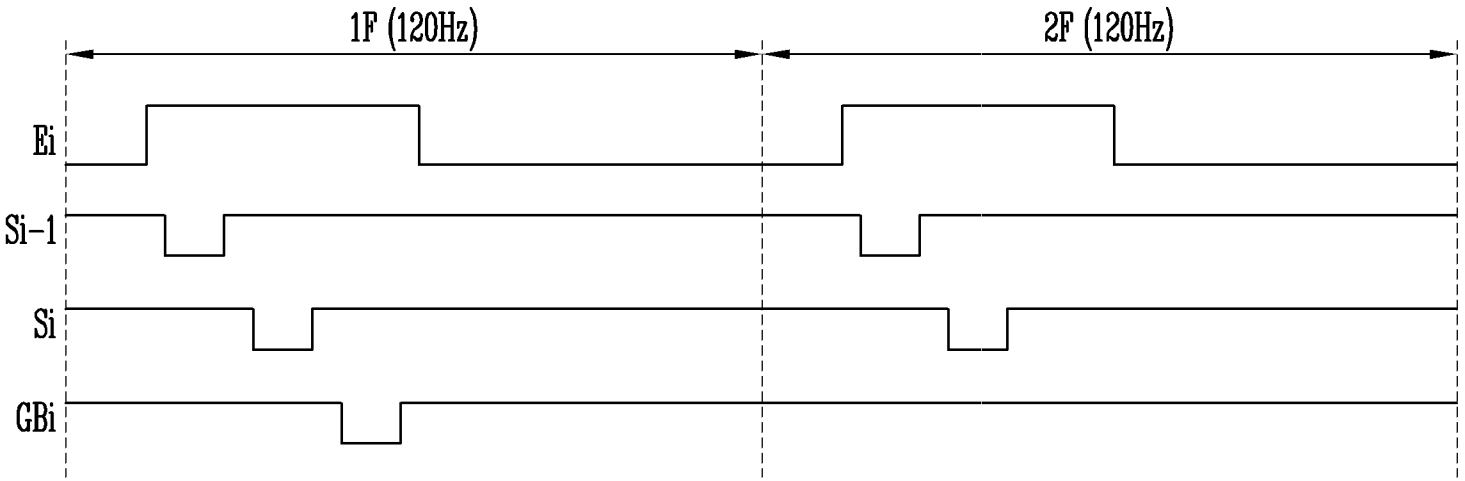
FIG. 4 is a waveform diagram illustrating a method of driving the pixel illustrated in FIG. 2 according to embodiments of the present disclosure.

FIG. 4 is a waveform diagram illustrating a method of driving the pixel 140 illustrated in FIG. 2 according to an embodiment of the present disclosure. In this case, it is assumed that the scan driver 110, the initialization driver 160, and the emission control driver 170 are all driven at the high frequency of 120 Hz per frame.

Referring to FIGS. 1, 2 and 4, the scan driver 110 may supply the scan signal to the pixel unit 130 every frame, and the emission control driver 170 may also supply the emission control signal to the pixel unit 130 every frame. On the other hand, the initialization driver 160 may supply the initialization signal to the pixel unit 130 every two frames.

First, the emission control signal may be supplied to the i-th emission control line Ei during a first frame 1F. When the emission control signal is supplied to the i-th emission control line Ei, the second transistor M2 and the third transistor M3 may be turned off.

When the third transistor M3 is turned off, the first power source ELVDD and the first electrode of the fourth transistor M4 may be electrically separated from each other. When the second transistor M2 is turned off, the second electrode of the fourth transistor M4 and the anode of the light emitting diode LED may be electrically separated from each other. Therefore, the pixel 140 may be set to the non-light emitting state during the period in which the emission control signal is supplied to the i-th emission control line Ei.

Thereafter, the scan signal may be supplied to the (i−1)th scan line Si−1. When the scan signal is supplied to the (i−1)th scan line Si−1, the sixth transistor M6 may be turned on. When the sixth transistor M6 is turned on, the voltage of the initialization power source Vint may be supplied to the first node N1.

After the scan signal is supplied to the (i−1)th scan line Si−1, the scan signal may be supplied to the i-th scan line Si. When the scan signal is supplied to the i-th scan line Si, the fifth transistor M5 and the seventh transistor M7 may be turned on.

When the fifth transistor M5 is turned on, the first node N1 and the second electrode of the fourth transistor M4 may be electrically connected to each other. That is, when the fifth transistor M5 is turned on, the fourth transistor M4 may be connected in the form of the diode.

When the seventh transistor M7 is turned on, the data signal from the m-th data line Dm may be supplied to the first electrode of the fourth transistor M4. In this case, since the first node N1 is initialized to the voltage of the initialization power source Vint, the fourth transistor M4 may be turned on. When the fourth transistor M4 is turned on, the voltage obtained by subtracting the absolute value of the threshold voltage of the fourth transistor M4 from the voltage of the data signal may be supplied to the first node N1. In this case, the storage capacitor Cst may store the voltage corresponding to the data signal and the threshold voltage of the fourth transistor M4.

Thereafter, the initialization signal may be supplied to the i-th initialization line GBi. When the initialization signal is supplied to the i-th initialization line GBi, the first transistor M1 may be turned on. When the first transistor M1 is turned on, the voltage of the initialization power source Vint may be supplied to the anode of the light emitting diode LED, and thus the parasitic capacitor of the light emitting diode LED may be discharged.

After the initialization signal is supplied to the i-th initialization line GBi, the supply of the emission control signal to the i-th emission control line Ei may be stopped. When the supply of the emission control signal to the i-th emission control line Ei is stopped, the second transistor M2 and the third transistor M3 may be turned on. When the third transistor M3 is turned on, the first power source ELVDD and the first electrode of the fourth transistor M4 may be electrically connected to each other. When the second transistor M2 is turned on, the second electrode of the fourth transistor M4 and the anode of the light emitting diode LED may be electrically connected to each other.

In this case, the fourth transistor M4 may control the amount of current flowing from the first power source ELVDD to the second power source ELVSS via the light emitting diode LED in response to the voltage of the first node N1. Then, the light emitting diode LED may emit light having a predetermined luminance corresponding to the amount of current supplied from the fourth transistor M4.

Meanwhile, as in the first frame 1F, the emission control signal may be supplied to the i-th emission control line Ei during a second frame 2F. Thereafter, the scan signal may be supplied to the (i−1)th scan line Si−1. In addition, after the scan signal is supplied to the (i−1)th scan line Si−1, the scan signal may be supplied to the i-th scan line Si. However, after the scan signal is supplied to the i-th scan line Si, the initialization signal may not be supplied to the i-th initialization Gbi.

When the initialization signal is not supplied to the i-th initialization line GBi, the first transistor M1 may be turned off. When the first transistor M1 is turned off, the voltage of the initialization power source Vint may not be supplied to the anode of the light emitting diode LED. Accordingly, the parasitic capacitor Coled of the light emitting diode LED may be maintained in a charged state.

Thereafter, the supply of the emission control signal to the i-th emission control line Ei may be stopped. When the supply of the emission control signal to the i-th emission control line Ei is stopped, the second transistor M2 and the third transistor M3 may be turned on. When the third transistor M3 is turned on, the first power source ELVDD and the first electrode of the fourth transistor M4 may be electrically connected to each other. When the second transistor M2 is turned on, the second electrode of the fourth transistor M4 and the anode of the light emitting diode LED may be electrically connected to each other.

In this case, the fourth transistor M4 may control the amount of current flowing from the first power source ELVDD to the second power source ELVSS via the light emitting diode LED in response to the voltage of the first node N1. Then, the light emitting diode LED may emit light having a predetermined luminance corresponding to the amount of current supplied from the fourth transistor M4. Substantially, as the above-described process is repeated, the pixels 140 may emit light with luminance corresponding to the data signal.

Figure 5:
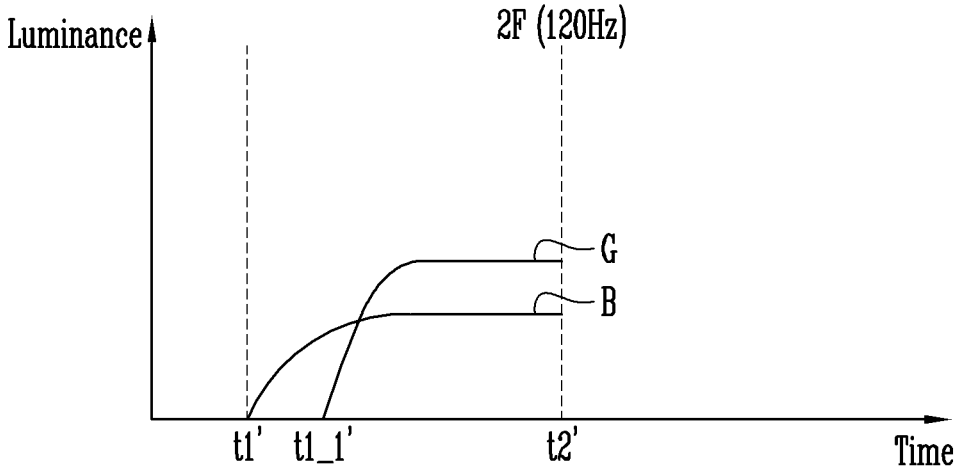
FIG. 5 is a diagram for explaining an effect when the initialization driver supplies an initialization signal to a pixel unit every two frames.

FIG. 5 is a diagram for explaining an effect when the initialization driver supplies an initialization signal to the pixel unit 130 every two frames.

Referring to FIGS. 4 and 5, the scan driver 110 may supply the scan signal to the pixel unit 130 every frame, but the initialization driver 160 may supply the initialization signal to the pixel unit 130 every two frames. Therefore, the light emitting time of the light emitting diode LED in the second frame 2F can be sufficiently secured.

That is, the light emitting diode LED emitting blue light B may be in the non-light emitting state during a first time t1' where the parasitic capacitor Coled is charged, and the light emitting diode LED emitting green light G may be in the non-light emitting state during a first time t1_1' where the parasitic capacitor Coled is charged. In this case, since the initialization driver 160 may not supply the initialization signal to the pixel unit 130 in the second frame 2F, the parasitic capacitor Coled of the light emitting diode LED may not be discharged. Therefore, the first times t1' and t1_1' where the parasitic capacitor Coled is charged may be relatively shorter than the first times t1 and t1_1 illustrated in FIG. 3C.

For this reason, even if the second time t2' corresponding to one frame in the case of driving with the high frequency, for example, 120 Hz, illustrated in FIG. 5 becomes relatively shorter than the second time t2 corresponding to one frame in the case of driving with the low frequency, for example, 60 Hz, illustrated in FIGS. 3A and 3B, since the first times t1' and t1_1' where the parasitic capacitor Coled is charged is unnecessary, the light emitting time of both the light emitting diodes LED emitting blue light B and green light G can be sufficiently secured even when the dispersion between the pixels 140 is taken into consideration. In other words, color deviation between the pixels 140 may be reduced, and power consumption may be reduced. Hereinafter, other embodiments will be described. In the following embodiments, description of the same configuration as the above-described embodiments will be omitted or simplified, and the differences will be mainly described.

Figure 6:
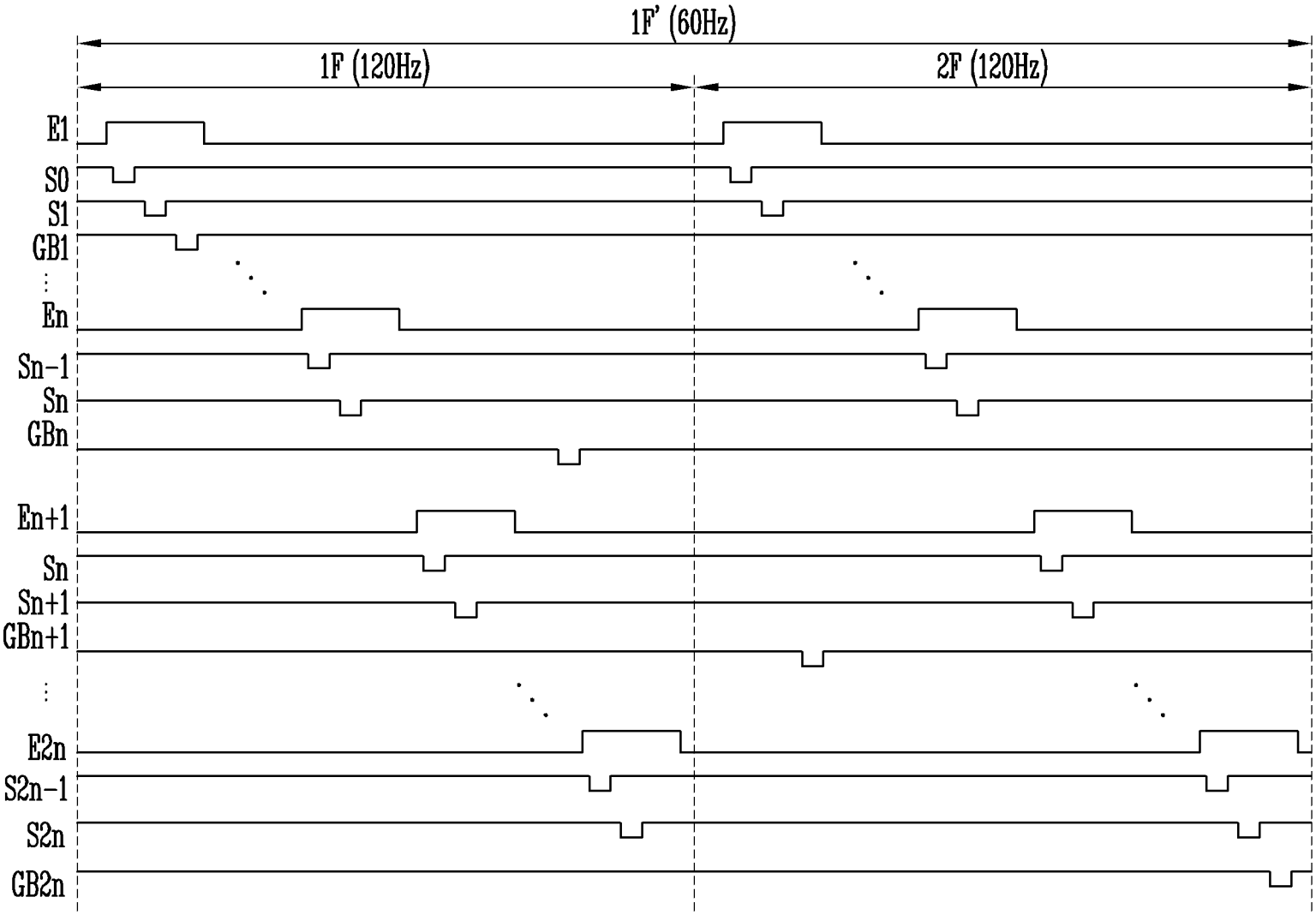
FIG. 6 is a waveform diagram illustrating a method of driving the pixel illustrated in FIG. 2 according to embodiments of the present disclosure.

FIG. 6 is a waveform diagram illustrating a method of driving the pixel 140 illustrated in FIG. 2 according to another embodiment of the present disclosure.

Referring to FIGS. 1, 2 and 6, as a difference from the embodiment illustrated in FIG. 4, the scan driver 110 and the emission control driver 170 may be driven at the high frequency such as 120 Hz per frame, for example, 1F and 2F, but the initialization driver 160 may be driven at the lower frequency, such as 60 Hz per frame, for example, 1F'.

Specifically, the emission control signal may be supplied to the i-th emission control line Ei during the first frame 1F driven at 120 Hz. Thereafter, the scan signal may be supplied to the (i−1)th scan line Si−1. After the scan signal is supplied to the (i−1)th scan line Si−1, the scan signal may be supplied to the i-th scan line Si−1.

As in the first frame 1F, the emission control signal may be supplied to the i-th emission control line Ei during the second frame 2F driven at 120 Hz. Thereafter, the scan signal may be supplied to the (i−1)th scan line Si−1. After the scan signal is supplied to the (i−1)th scan line Si−1, the scan signal may be supplied to the i-th scan line Si.

Meanwhile, after the scan signal is supplied to a first scan line S1, the initialization signal may be supplied to a first initialization line GB1. However, the initialization driver 160 may sequentially supply the initialization signals to first to 2n-th initialization lines GB1 to GB2*n* during a first frame 1F' driven at 60 Hz.

During the first frame 1F of the scan driver 110 and the emission control driver 170, the initialization driver 160 may sequentially supply the initialization signals to the first to n-th initialization lines. In addition, during the second frame 2F of the scan driver 110 and the emission control driver 170, the initialization driver 160 may sequentially supply the initialization signals to the (n+1)th to 2n-th initialization lines.

That is, one frame of the initialization driver 160 driven at 60 Hz may correspond to two frames of the scan driver 110 and the emission control driver 170 driven at 120 Hz. Therefore, the initialization driver 160 may sequentially supply the initialization signals to the first to 2n-th initialization lines GB1 to GB2*n* during the two frames of the scan driver 110 and the emission control driver 170. For this reason, the same or similar effect as the embodiment illustrated in FIG. 4 is obtained.

Figure 7:
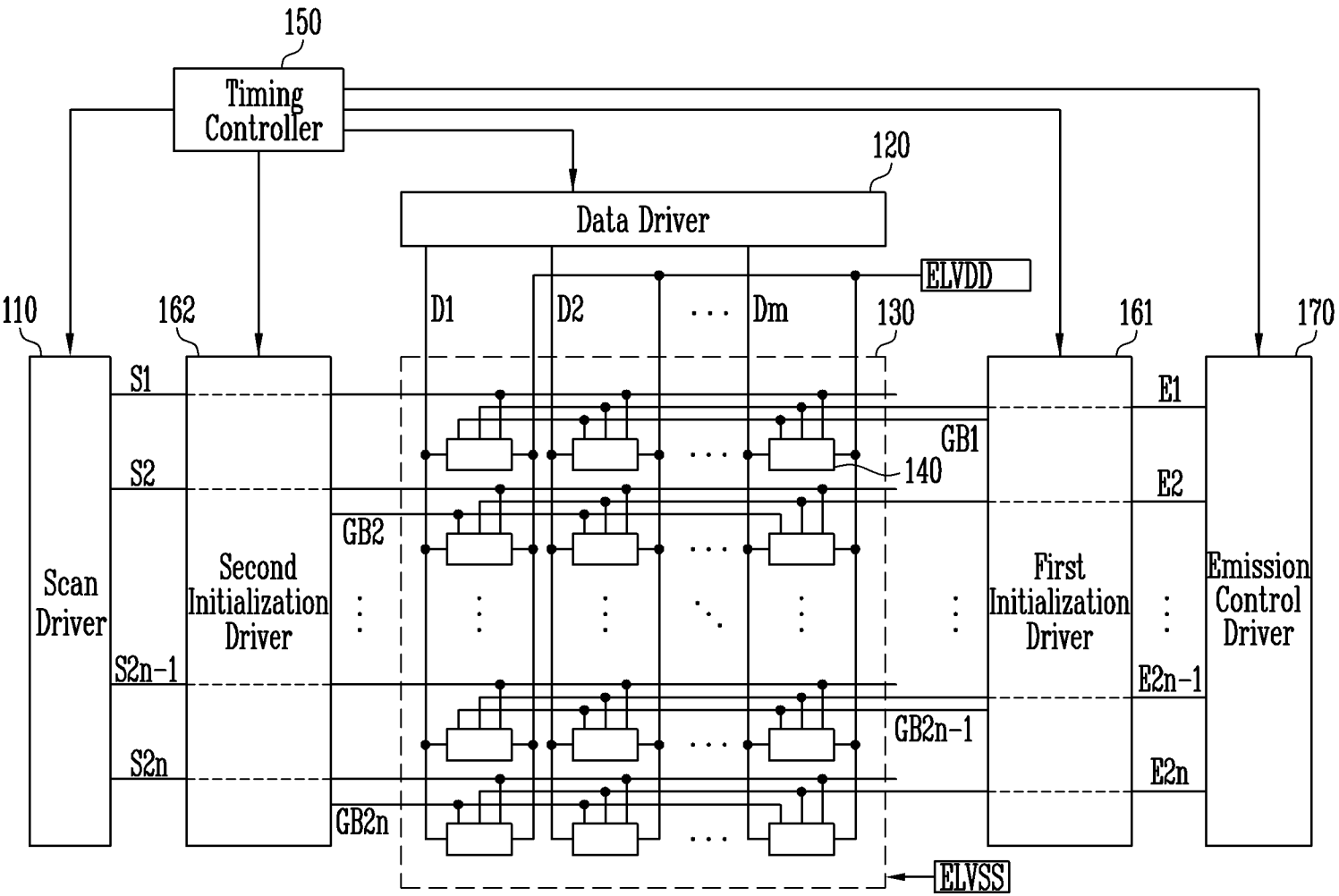
FIG. 7 is a block diagram illustrating a display device according to embodiments of the present disclosure.

FIG. 7 is a block diagram illustrating a display device according to another embodiment of the present disclosure.

Referring to FIG. 7, as a difference from the embodiment illustrated in FIG. 1, a display device may include not only a first initialization driver 161 located on one side of the pixel unit 130 but also a second initialization driver 162 located on the other side of the pixel unit 130.

In detail, the first initialization driver 161 may be connected to odd-numbered initialization lines GB1 and GB3 to GB2*n*−1. The second initialization driver 162 may be connected to even-numbered initialization lines GB2 and GB4 to GB2*n*. Thus, initialization signals provided from outside and composed of a combination of a gate-on voltage and a gate-off voltage may be applied to the initialization lines GB1 to GB2*n*. The first and second initialization drivers 161 and 162 may be substantially configured as shift registers, and may include stages arranged in a line. In addition, the first and second initialization drivers 161 and 162 may be formed to be integrated in the same manufacturing process as switching elements of the pixels 140. However, the first and second initialization drivers 161 and 162 may be mounted in the form of an integrated circuit.

Figure 8:
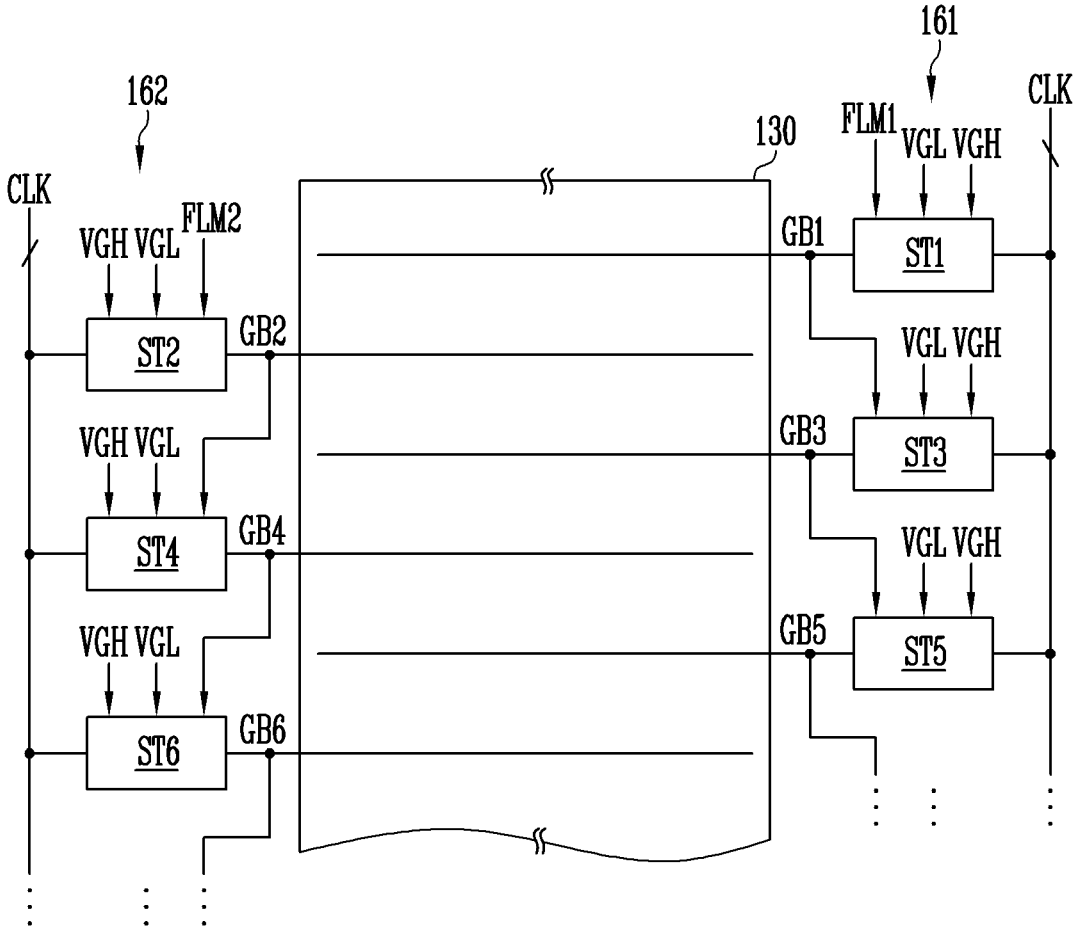
FIG. 8 is a block diagram illustrating an example of an initialization driver illustrated in FIG. 7.

FIG. 8 is a block diagram illustrating an example of an initialization driver illustrated in FIG. 7.

Referring to FIG. 8, the first initialization driver 161 may supply the initialization signals only to the odd-numbered initialization lines GB1 and GB3 to GB2*n*−1. For example, the first initialization driver 161 may include stages ST1, ST3, and ST5 that are dependently connected to each other. The stages ST1, ST3, and ST5 may be connected to the corresponding initialization lines GB1, GB3, and GB5, respectively, to sequentially output the initialization signals.

Each of the stages ST1, ST3, and ST5 may receive a first voltage VGL and a second voltage VGH having a level higher than that of the first voltage VGL. In addition, each of the stages ST1, ST3, and ST5 may receive at least one clock signal CLK. The at least one clock signal CLK may have the same period. According to an embodiment of the present disclosure, the first initialization driver 161 may sequentially output the initialization signals having an activation level at one cycle interval of the clock signal CLK.

A first stage ST1 may be driven by receiving a first start signal FLM1. In detail, the first stage ST1 may receive the first and second voltages VGL and VGH, and provide an initialization signal to the first initialization line GB1 in response to the first start signal FLM1 and the clock signal CLK. The initialization signal may be provided to the corresponding pixels 140 (refer to FIG. 7) arranged in units of rows through the first initialization line GB1.

The stages ST3 and ST5 except the first stage ST1 may be dependently connected to each other to be sequentially driven. For example, a third stage ST3 may receive the initialization signal output from the first stage ST1 which is the previous stage. The third stage ST3 may receive the first and second voltages VGL and VGH, and supply the initialization signal to a third initialization line GB3 in response to the initialization signal supplied through the first initialization line GB1 and the clock signal CLK. Since the other stage ST5 is also operated in substantially the same manner, a detailed description thereof will be omitted.

The second initialization driver 162 may supply the initialization signals only to the even-numbered initialization lines GB2 and GB4 to GB2*n*. For example, the second initialization driver 162 may include stages ST2, ST4, and ST6 that are dependently connected to each other. The stages ST2, ST4, and ST6 may be connected to the corresponding initialization lines GB2, GB4, and GB6, respectively, to sequentially output the initialization signals.

Each of the stages ST2, ST4, and ST6 may receive the first voltage VGL and the second voltage VGH having a level higher than that of the first voltage VGL. In addition, each of the stages ST2, ST4, and ST6 may receive at least one clock signal CLK. The at least one clock signal CLK may have the same period. According to an embodiment of the present disclosure, the second initialization driver 162 may sequentially output the initialization signals having an activation level at one cycle interval of the clock signal CLK.

A second stage ST2 may be driven by receiving a second start signal FLM2. In detail, the second stage ST2 may receive the first and second voltages VGL and VGH, and provide an initialization signal to a second initialization line GB2 in response to the second start signal FLM2 and the clock signal CLK. The initialization signal may be provided to the corresponding pixels 140 (refer to FIG. 7) arranged in units of rows through the second initialization line GB2.

The stages ST4 and ST6 except the second stage ST2 may be dependently connected to each other to be sequentially driven. For example, a fourth stage ST4 may receive the initialization signal output from the second stage ST2 which is the previous stage. The fourth stage ST4 may receive the first and second voltages VGL and VGH, and supply the initialization signal to a fourth initialization line GB4 in response to the initialization signal supplied through the second initialization line GB2 and the clock signal CLK. Since the other stage ST6 is also operated in substantially the same manner, a detailed description of the operation will be omitted.

Figure 9:
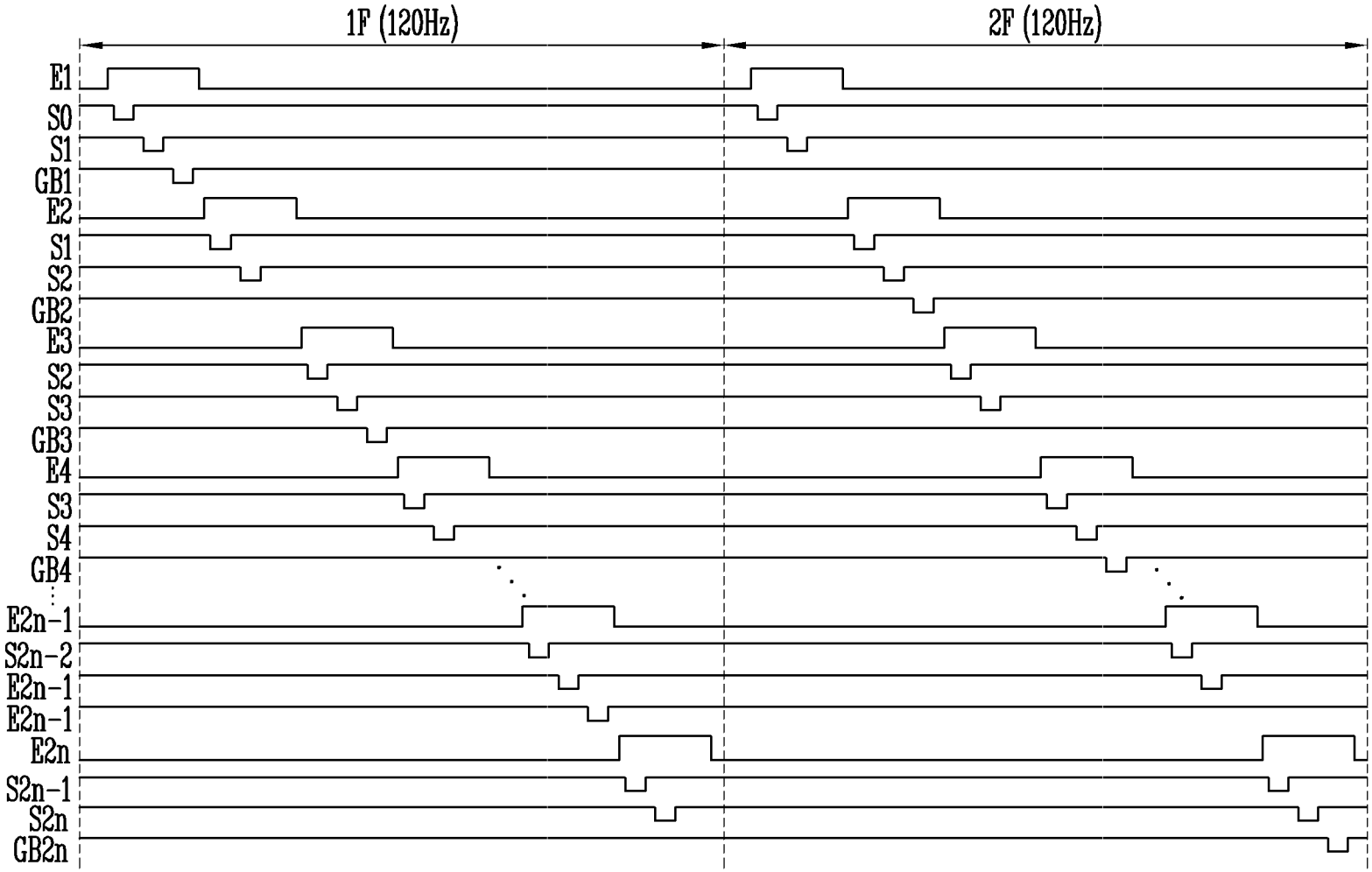
FIG. 9 is a waveform diagram illustrating a method of driving a pixel illustrated in FIG. 7.

FIG. 9 is a waveform diagram illustrating a method of driving a pixel 140 illustrated in FIG. 7.

Referring to FIGS. 2, 7, 8 and 9, as a difference from the embodiment illustrated in FIG. 4, the first initialization driver 161 may supply the initialization signals only to the odd-numbered initialization lines GB1, GB3 to GB2*n*−1 during odd-numbered frames. The second initialization driver 162 may supply the initialization signals only to the even-numbered initialization lines GB2 and GB4 to GB2*n* during even-numbered frames.

In detail, the emission control signal may be supplied to the first emission control line E1 during the first frame 1F driven at 120 Hz. Thereafter, the scan signal may be supplied to a zero-th scan line S0. Thereafter, the scan signal may be supplied to the first scan line S1. After the scan signal is supplied to the first scan line S1, the initialization signal may be supplied to the first initialization line GB1.

Next, the emission control signal may be supplied to the second emission control line E2. Thereafter, the scan signal may be supplied to the first scan line S1. Thereafter, the scan signal may be supplied to a second scan line S2. However, after the scan signal is supplied to the second scan line S2, the initialization signal may not be supplied to the second initialization line GB2.

Next, the emission control signal may be supplied to the third emission control line E3. Thereafter, the scan signal may be supplied to the second scan line S2. Thereafter, the scan signal may be supplied to a third scan line S3. After the scan signal is supplied to the third scan line S3, the initialization signal may be supplied to the third initialization line GB3.

Next, the emission control signal may be supplied to the fourth emission control line E4. Thereafter, the scan signal may be supplied to the third scan line S3. Thereafter, the scan signal may be supplied to a fourth scan line S4. However, after the scan signal is supplied to the fourth scan line S4, the initialization signal may not be supplied to the fourth initialization line GB4.

That is, the first initialization driver 161 may supply the initialization signals only to the odd-numbered initialization lines GB1 and GB3 to GB2*n*−1 during the odd-numbered frames.

Meanwhile, the emission control signal may be supplied to the first emission control line E1 during the second frame 2F driven at 120 Hz. Thereafter, the scan signal may be supplied to the zero-th scan line S0. Thereafter, the scan signal may be supplied to the first scan line S1. However, after the scan signal is supplied to the first scan line S1, the initialization signal may not be supplied to the first initialization line GB1.

Next, the emission control signal may be supplied to the second emission control line E2. Thereafter, the scan signal may be supplied to the first scan line S1. Thereafter, the scan signal may be supplied to the second scan line S2. After the scan signal is supplied to the second scan line S2, the initialization signal may be supplied to the second initialization line GB2.

Next, the emission control signal may be supplied to the third emission control line E3. Thereafter, the scan signal may be supplied to the second scan line S2. Thereafter, the scan signal may be supplied to the third scan line S3. However, after the scan signal is supplied to the third scan line S3, the initialization signal may not be supplied to the third initialization line GB3.

Next, the emission control signal may not be supplied to the fourth emission control line E4. Thereafter, the scan signal may be supplied to the third scan line S3. Thereafter, the scan signal may be supplied to the fourth scan line S4. After the scan signal is supplied to the fourth scan line S4, the initialization signal may be supplied to the fourth initialization line GB4.

That is, the second initialization driver 162 may supply the initialization signals only to the even-numbered initialization lines GB2 and GB2 to GB2*n* during the even-numbered frames.

For this reason, the same or similar effect as the embodiment illustrated in FIG. 4 are obtained.

The display device according to the embodiment of the present disclosure may discharge the parasitic capacitor of the light emitting diode every set of frames when driving at the high frequency. Therefore, occurrence of luminance and color deviation between the pixels at low grayscale can be reduced.

In the display device according to the embodiment of the present disclosure, a driving frequency of the initialization driver may be set to be different from driving frequencies of the scan driver and the light emission control driver to discharge the parasitic capacitor of the light emitting diode. Therefore, the occurrence of luminance and color deviation between the pixels at the low grayscale can be reduced.

The technical idea of the present disclosure has been described in detail according to the above-described embodiments. However, it should be noted that the above-described embodiments are for illustrative purposes only and are not intended to limit the present disclosure. In addition, those skilled in the art will appreciate that various modifications are possible within the scope of the technical idea of the present disclosure.

The scope of the present disclosure is not limited to the detailed description of the specification, but should be determined by the appended claims. In addition, it should be construed that the meaning and scope of the claims and all changes or modifications derived from equivalent concepts are comprised in the scope of the present disclosure.

What is claimed is:

1. A display device comprising:

a light emitting diode;

a first transistor connected between an initialization power source and an anode of the light emitting diode and having a gate electrode connected to an initialization line;

a scan driver for supplying a scan signal to a scan line;

an emission control driver for supplying an emission control signal to an emission control line; and an initialization driver for supplying an initialization signal to the initialization line, wherein the scan driver is driven at a first frequency and supplies the scan signal every one frame, wherein the emission control driver is driven at the first frequency and supplies the emission control signal every one frame, and wherein the initialization driver supplies the initialization signal every set of two or more frames when driven at the first frequency.

2. The display device of claim 1, wherein the initialization driver supplies the initialization signal every frame when driven at a second frequency different from the first frequency, and wherein the first frequency is higher than the second frequency.

3. The display device of claim 2, wherein the first frequency is 120 Hz and the second frequency is 60 Hz.

4. The display device of claim 1, wherein the set consists of two frames.

5. The display device of claim 1, further comprising:

a data driver for supplying a data signal to a data line; and a timing controller for controlling the scan driver, the data driver, the emission control driver, and the initialization driver.

6. The display device of claim 5, further comprising:

a second transistor having a first electrode connected to the anode of the light emitting diode and a gate electrode connected to the emission control line;

a third transistor having a first electrode connected to a first power source and a gate electrode connected to the emission control line;

a fourth transistor having a first electrode connected to a second electrode of the third transistor, a second electrode connected to a second electrode of the second transistor, and a gate electrode connected to a first node;

a fifth transistor connected between the first node and the second electrode of the fourth transistor and having a gate electrode connected to a first scan line;

a sixth transistor connected between the first node and the initialization power source and having a gate electrode connected to a second scan line;

a seventh transistor connected between the data line and the first electrode of the fourth transistor and having a gate electrode connected to the first scan line; and a storage capacitor connected between the first power source and the first node.

7. The display device of claim 6, wherein the scan driver supplies the scan signal to the first scan line every frame to overlap the emission control signal.

8. The display device of claim 7, wherein the initialization driver supplies the initialization signal every the set to overlap the emission control signal when driven at the first frequency.

9. The display device of claim 8, wherein the initialization signal is supplied after the scan signal and the initialization signal and the scan signal do not overlap each other.

10. The display device of claim 5, wherein the initialization driver supplies the initialization signal every frame regardless of the emission control signal when driven at a second frequency different from the first frequency, and wherein the first frequency is higher than the second frequency.

11. A method of driving a display device, the method comprising:

supplying a scan signal to a scan line by a scan driver;

supplying an emission control signal to an emission control line by an emission control driver; and supplying an initialization signal to the initialization line by an initialization driver, wherein the scan driver is driven at a first frequency and supplies the scan signal every one frame, wherein the emission control driver is driven at the first frequency and supplies the emission control signal every one frame, and wherein the initialization driver supplies the initialization signal every set of two or more frames when driven at the first frequency to apply an initialization voltage to an anode of a light emitting diode of a pixel of pixels.

12. The method of claim 11, further comprising:

supplying the initialization signal every frame when driven at a second frequency different from the first frequency to apply the initialization voltage to the anode of the light emitting diode.

13. The method of claim 12, further comprising:

setting the pixels to a non-light emitting state before applying the initialization voltage to the anode of the light emitting diode; and charging the pixels with a voltage corresponding to a data signal, wherein the pixels sequentially emit light in units of horizontal lines to correspond to the charged voltage.

14. The method of claim 12, wherein the first frequency is higher than the second frequency.

15. The method of claim 14, wherein the first frequency is 120 Hz and the second frequency is 60 Hz.

* * * * *